US012607357B2

(12) United States Patent
Hu

(10) Patent No.: US 12,607,357 B2
(45) Date of Patent: Apr. 21, 2026

(54) COMBUSTOR WITH FUEL PLENUM AND EXTENDING MIXING PASSAGES

(71) Applicant: Pratt & Whitney Canada Corp., Longueuil (CA)

(72) Inventor: Tin Cheung John Hu, Markham (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 288 days.

(21) Appl. No.: 18/105,012

(22) Filed: Feb. 2, 2023

(65) Prior Publication Data

US 2024/0263789 A1 Aug. 8, 2024

(51) Int. Cl.

| | |
|---|---|
| ***F23R 3/00*** | (2006.01) |
| ***F23D 14/82*** | (2006.01) |
| ***F23R 3/28*** | (2006.01) |

(52) U.S. Cl.

CPC ..... *F23R 3/286* (2013.01); *F23D 14/82* (2013.01); *F23D 2212/20* (2013.01)

(58) Field of Classification Search

None

See application file for complete search history.

(56) References Cited

U.S. PATENT DOCUMENTS

| | | | |
|---|---|---|---|
| 4,100,733 | A | 7/1978 | Striebel et al. |
| 4,578,946 | A | 4/1986 | Readman et al. |
| 5,836,289 | A | 11/1998 | Thring |
| 6,145,496 | A | 11/2000 | Pace et al. |
| 6,267,585 | B1 | 7/2001 | Suttrop |
| 7,017,329 | B2 | 3/2006 | Farhangi et al. |
| 7,832,212 | B2 | 11/2010 | Bunker |
| 7,870,736 | B2 | 1/2011 | Homitz et al. |
| 8,266,911 | B2 | 9/2012 | Evulet |
| 8,413,445 | B2 | 4/2013 | Poyyapakkam |
| 8,539,773 | B2 | 9/2013 | Ziminsky et al. |
| 8,661,779 | B2 | 3/2014 | Laster et al. |

(Continued)

FOREIGN PATENT DOCUMENTS

| | | |
|---|---|---|
| CN | 101220955 | 7/2008 |
| CN | 206113000 | 4/2017 |

(Continued)

OTHER PUBLICATIONS

GE, Gas Turbines: Hydrogen Capacility and Experience, 2020 (Year: 2020).*

(Continued)

*Primary Examiner* — Edwin Kang

(74) *Attorney, Agent, or Firm* — Carlson, Gaskey & Olds, P.C.

(57) ABSTRACT

A combustor for a gas turbine engine includes a liner surrounding a fuel and air mixing body. A fuel supply passage communicates into an open fuel plenum downstream of the fuel supply passage. A wall of the mixing body has air openings to receive air flow, and communicate air into mixing passages. The mixing passages pass through the fuel plenum. Fuel openings in the mixing passages to allow fuel to flow from the mixing passage and mix with the air. There are passage sections extending downstream of the fuel plenum, such that the mixed air and fuel travels downstream of the fuel plenum and into a combustion chamber. A gas turbine engine is also disclosed.

6 Claims, 3 Drawing Sheets

(56) References Cited

U.S. PATENT DOCUMENTS

| | | | | |
|---|---|---|---|---|
| 8,893,500 | B2 | 11/2014 | Oskam | |
| 9,360,220 | B2 | 6/2016 | Chen et al. | |
| 9,771,869 | B2 | 9/2017 | Li et al. | |
| 9,803,866 | B2 | 10/2017 | Yoshino | |
| 9,976,522 | B2 | 5/2018 | Patel et al. | |
| 10,024,539 | B2 | 7/2018 | Simmons | |
| 10,082,294 | B2 | 9/2018 | Laster et al. | |
| 10,267,522 | B2 | 4/2019 | Ciani et al. | |
| 10,502,425 | B2 | 12/2019 | Boardman et al. | |
| 10,704,786 | B2 | 7/2020 | Laster et al. | |
| 10,865,989 | B2 | 12/2020 | Sadasivuni | |
| 10,941,940 | B2 | 3/2021 | Bulat et al. | |
| 11,067,280 | B2 | 7/2021 | Boardman et al. | |
| 2008/0276618 | A1 | 11/2008 | Poyyapakkam | |
| 2010/0192581 | A1 | 8/2010 | Ziminsky et al. | |
| 2011/0083439 | A1 | 4/2011 | Zuo et al. | |
| 2011/0185703 | A1 | 8/2011 | Dodo et al. | |
| 2012/0058437 | A1* | 3/2012 | Uhm | F23R 3/54 431/9 |
| 2012/0227411 | A1 | 9/2012 | Carroni et al. | |
| 2013/0104556 | A1* | 5/2013 | Uhm | F23R 3/002 60/722 |
| 2014/0033718 | A1* | 2/2014 | Manoharan | F23R 3/10 60/725 |
| 2014/0157779 | A1 | 6/2014 | Uhm et al. | |
| 2017/0211807 | A1* | 7/2017 | Graichen | F23R 3/283 |
| 2017/0227224 | A1 | 8/2017 | Oskam et al. | |
| 2017/0307210 | A1 | 10/2017 | Hirano et al. | |
| 2021/0172413 | A1 | 6/2021 | Snyder | |

FOREIGN PATENT DOCUMENTS

| | | |
|---|---|---|
| EP | 1923637 | 5/2008 |
| JP | 2013108667 | 6/2013 |
| JP | 5538113 | 7/2014 |
| JP | 5926635 | 5/2016 |
| WO | 2016051756 | 4/2016 |
| WO | 2020259919 | 12/2020 |

OTHER PUBLICATIONS

Marek et al, Low Emission Hydrogen Combustors for Gas Turbines Using Lean Direct Injection, 2005 (Year: 2005).*

Brown et al, Hydrogen as a Fuel for Gas Turbines, 2020 (Year: 2020).*

European Search Report for EP Application No. 24155634.9 dated Jun. 5, 2024.

* cited by examiner

COMBUSTOR WITH FUEL PLENUM AND EXTENDING MIXING PASSAGES

BACKGROUND

This application relates to a combustor for a gas turbine engine wherein a fuel plenum receives a source of gaseous fuel, such as hydrogen, and has passages to mix the fuel with air.

Gas turbine engines are known, and typically include a compressor delivering compressed air into a combustor. Compressed air is mixed with fuel and ignited. Products of the combustion pass downstream over turbine rotors, driving them to rotate. The turbine rotors in turn rotate the compressor rotors and propulsor rotors such as a fan or propeller.

Historically, aviation fuel has been utilized with gas turbine engines, especially for aircraft applications. More recently it has been proposed to utilize hydrogen ($H_2$) as a fuel.

SUMMARY

A combustor for a gas turbine engine includes a liner surrounding a fuel and air mixing body. A fuel supply passage communicates into an open fuel plenum downstream of the fuel supply passage. A wall of the mixing body has air openings to receive air flow, and communicate air into mixing passages. The mixing passages pass through the fuel plenum. Fuel openings in the mixing passages to allow fuel to flow from the mixing passage and mix with the air. There are passage sections extending downstream of the fuel plenum, such that the mixed air and fuel travels downstream of the fuel plenum and into a combustion chamber.

These and other features will be best understood from the following drawings and specification, the following is a brief description.

DETAILED DESCRIPTION

Figure 1:
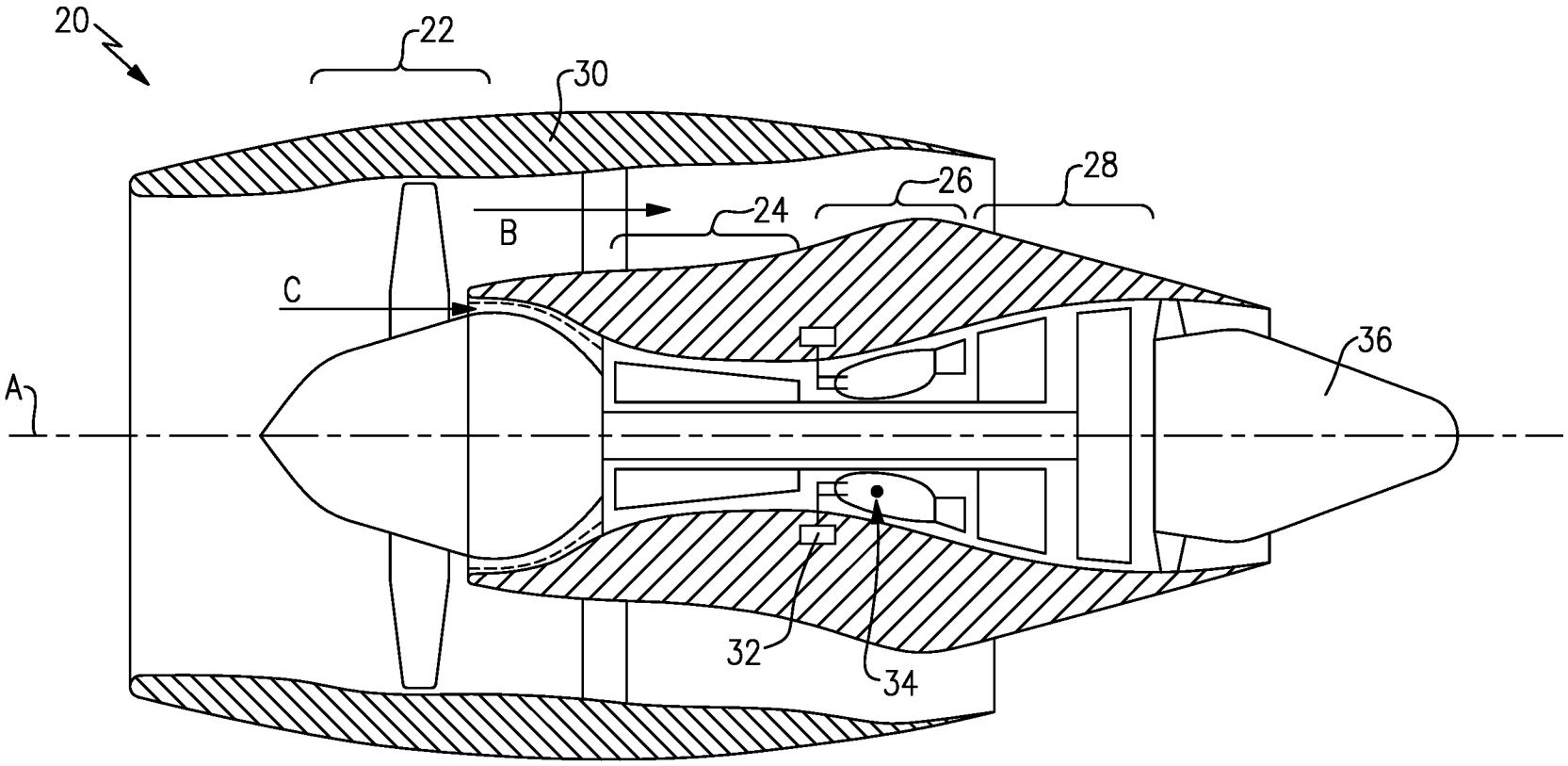
FIG. 1 schematically shows a gas turbine engine.

FIG. 1 schematically illustrates a gas turbine engine 20. The example gas turbine engine 20 is a turbofan that generally incorporates a fan section 22, a compressor section 24, a combustor section 26 and a turbine section 28. The fan section 22 drives air along a bypass flow path B in a bypass duct defined within a nacelle 30. The turbine engine 20 intakes air along a core flow path C into the compressor section 24 for compression and communication into the combustor section 26. In the combustor section 26, the compressed air is mixed with fuel from a fuel system 32 and ignited by igniter 34 to generate an exhaust gas flow that expands through the turbine section 28 and is exhausted through exhaust nozzle 36. Although depicted as a turbofan turbine engine in the disclosed non-limiting embodiment, it should be understood that the concepts described herein are not limited to use with turbofans as the teachings may be applied to other types of turbine engines. As one example, rather than having the propulsor be an enclosed fan, the propulsor may be an open propeller. This may be applicable to an industrial gas turbine engine as well.

A gas turbine engine as disclosed in this application will utilize gaseous fuel such as hydrogen ($H_2$). Challenges are faced by the use of hydrogen, and in particular combustor structure which might be appropriate for liquid aviation fuel may not be as applicable for hydrogen as a fuel.

One challenge when utilizing hydrogen as a fuel is that it is in a gaseous state inside the combustor and more readily flammable than the liquid aviation fuel. This could raise challenges with flashback if the local flame speed is higher than the fuel-air mixture inlet speed into the combustor.

Figure 2B:
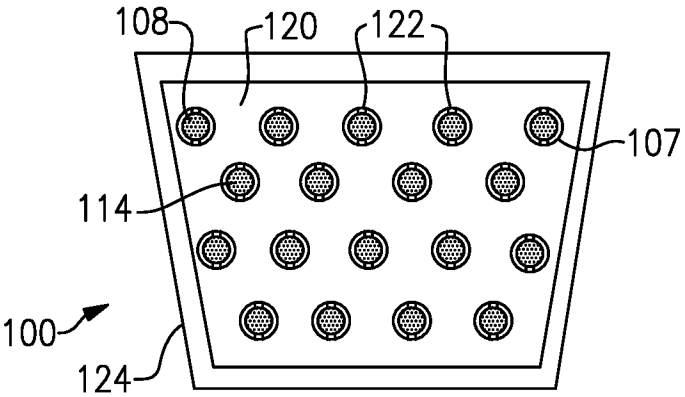
FIG. 2B is a view along line B-B of FIG. 2A.
Figure 2C:
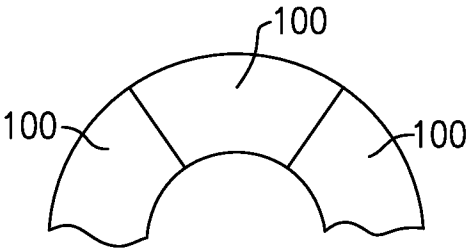
FIG. 2C is an end view of a combustor according to this disclosure.
Figure 2A:
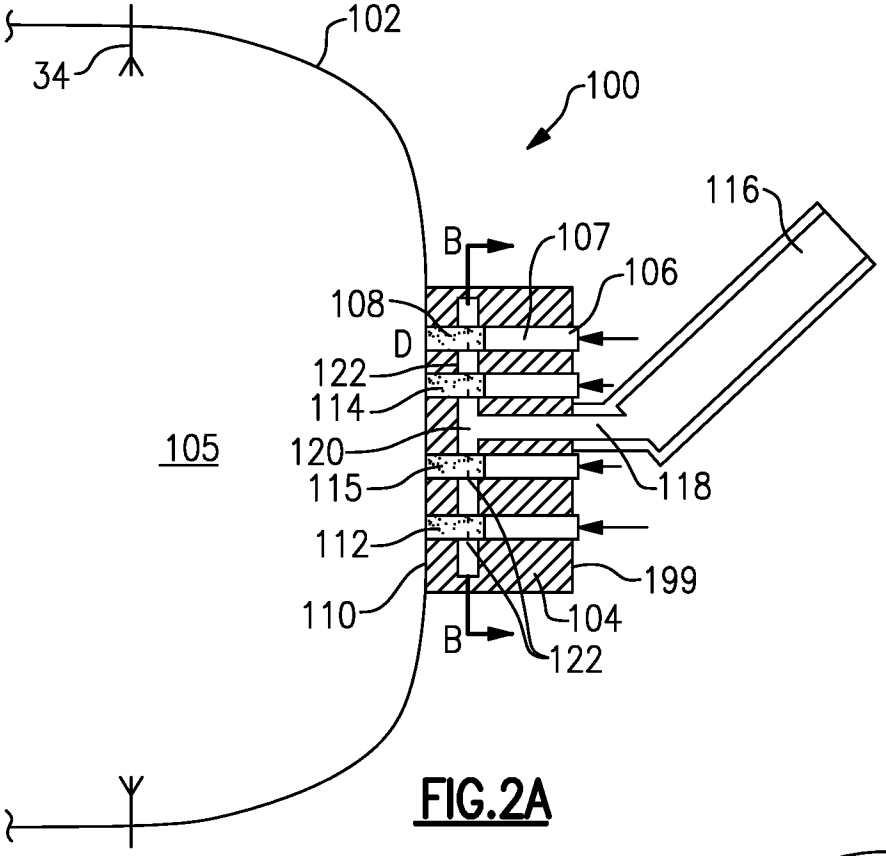
FIG. 2A shows a first embodiment combustor.

FIG. 2A shows a combustor section 100 which is designed to delay ignition downstream of a hydrogen feed. The combustor 100 has a liner 102 (shown partially) extending around an axis of rotation of the engine such as the engine shown in FIG. 1. Ignition structure 34 is shown schematically.

A mixing body 104 receives air through a plurality of air openings 106 in an end wall 199 of the body 104. That air passes into mixing passages 107, and extends forwardly towards a combustion chamber 105.

Fuel is injected from a hydrogen feed 116 into a central inlet 118, and then into an open fuel plenum 120. Hydrogen fuel in the plenum 120 may then move into the mixing passages 107.

As shown, small openings 122 (See FIG. 2B) communicate fuel from the plenum 120 into the mixing passages 107. Passage sections 108 extend downstream of the plenum 120, and may include structure to delay ignition.

In one embodiment, the structure may be a porous metal foam or cellular metallic materials (CMM). Appropriate metals for use in combustion application are known. One potentially valuable metal foam would be formed of steel, such as Inconel®.

The fuel and air mix in the mixing passages 107 passes into passage sections 108 and into the combustion chamber 105 through an end face 110. Openings 112 are formed to allow the mixed fuel and air to move into the combustion chamber 105 from the passage sections 108.

By having the passage sections 108 downstream of the plenum 120, the ignition will occur downstream of the openings 112, and the passage sections 108. The included metal foam or cellular metallic materials (CMM) 114 will also resist flashback into the passage sections 108 and toward the plenum 120. Hence, the metal foam or CMM acts as a flame arrestor. The passage openings 112 can be sized to control the fuel-air mixture exit velocity higher than the local flame speed as another flashback avoidance control parameter as well.

FIG. 2B shows an outer periphery 124 of the combustor section 100. As can be seen the outer periphery is polygonal. One can see the passage sections 108 and the openings 122 communicating the plenum 122 and mixing passages 107. Moreover, metal foam 114 is also shown. While metal foam is specifically disclosed, any appropriate material having an open cell structure or as a cellular metallic material (CMM) may be utilized with this disclosure.

As is clear from FIGS. 2A and 2B the cellular material 108 is not just downstream of the location of openings 122, but also disposed at the location.

As schematically shown in FIG. 2C, there are a plurality of combustor sections 100 having feed structure in discrete panels, such as shown in FIGS. 2A and 2B.

Figure 3B:
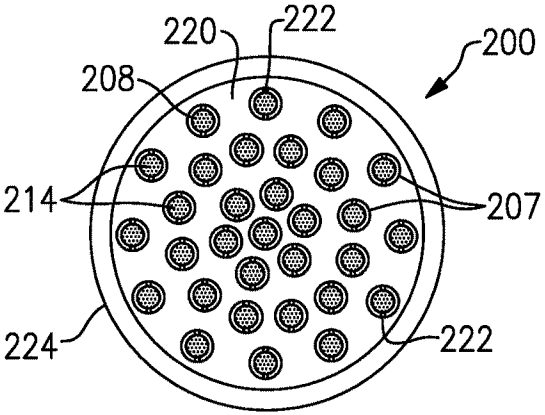
FIG. 3B is a view along line B-B of FIG. 3A.
Figure 3A:
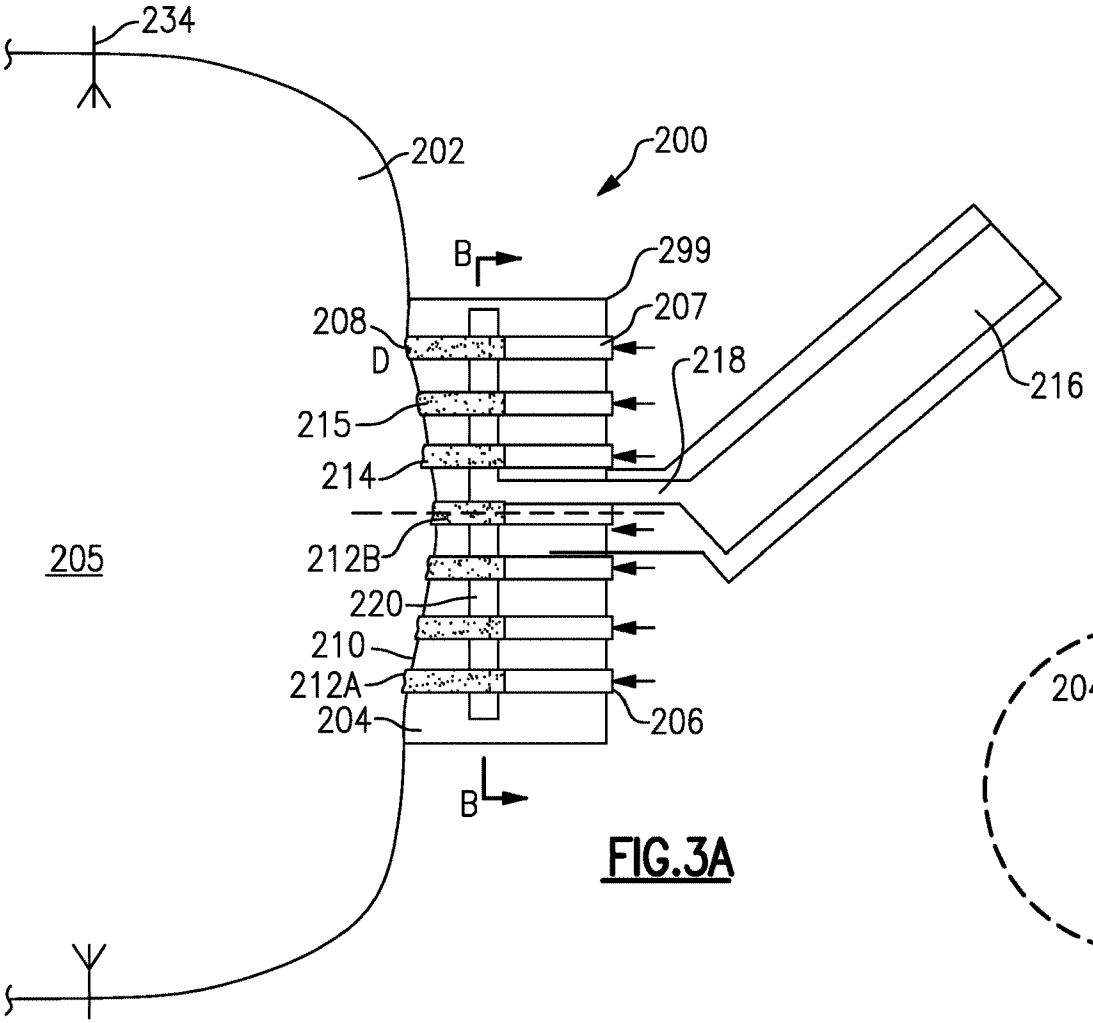
FIG. 3A shows a distinct embodiment combustor.

FIG. 3A shows a combustor section 200 in a distinct embodiment. Reference numerals that are similar to those disclosed with regard to FIG. 2A have been changed to include the initial number 200. Again, ignition structure 234 is shown to delay combustion until the combustor chamber 205. The liner 202 surrounds a mixing body 204. Air openings 206 in end wall lead to passage sections 207. A gaseous hydrogen fuel supply 216 leads to a central passage 218, and then into an open plenum 220.

Downstream passage sections 208 extends downstream beyond the plenum 220 and have openings 212 which communicates mixed fuel and air into the combustion chamber 205. Openings 222 allow fuel to flow from the plenum 220 into sections 208. The sections 208 are provided with an open cell structure 214 such as a metal foam or cellular metallic materials (CMM).

As can be appreciated with a comparison of FIGS. 2A and 3A, a forward face 110 of the FIG. 2A embodiment is generally perpendicular to a central axis of the engine. In contrast a forward face 210 of the FIG. 3A embodiment has a shape which ends axially closer to the plenum 220 at more central locations as shown at opening 212B. More outward openings 212A extend further downstream. The concave shape of the inner face allows protrusion of the individual passages into the combustor to be of distinct lengths to optimize flame stability.

FIG. 3B shows the outer periphery 224 of the section 200 is generally cylindrical. Again, passage sections 208 receive open cell material 214. Openings 222 communicate fuel from the plenum 220 into the passage section 208.

The central feed 218 can be used as a reference to understand that the passage sections 208 are positioned circumferentially and radially on each side of an axis of the central supply passage 218. Moreover, with regard to FIG. 3A, passage sections 208 and opening 212B which are closer to the central feed 218 extend for the shorter axial length than do sections such as sections 208 and opening 212A spaced further from the central passage 218.

A combustor 100/200 for a gas turbine engine under this disclosure could be said to include a liner 102/202 surrounding a fuel and air mixing body 104/204 and a fuel supply passage 118/218. The fuel supply passage communicates into an open fuel plenum 120/220 downstream of the fuel supply passage. A wall 199/299 of the mixing body has air openings 106/206 to receive air flow, and communicates air into mixing passages 107/207.

The mixing passages pass through the fuel plenum. Fuel openings 122/222 in the mixing passages allow fuel to flow from the fuel plenum into the mixing passages and mix with the air. Passage sections 108/208 extend downstream of the fuel plenum, such that the mixed air and fuel travel downstream of the fuel plenum and into a combustion chamber 105/205.

Figure 4:
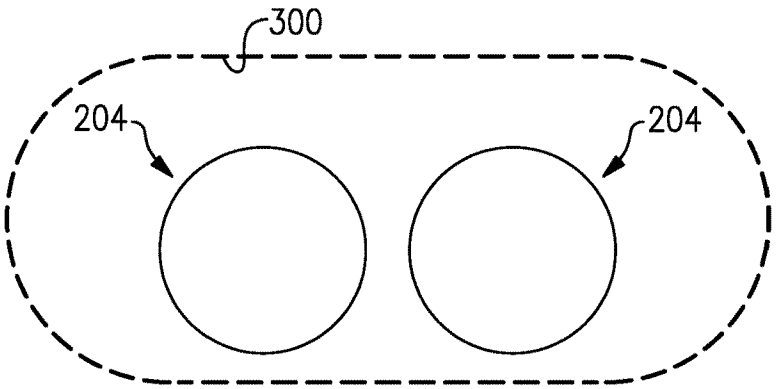
FIG. 4 schematically shows an optional feature.

While a single mixing device may be sufficient for a small combustor as shown in FIGS. 2A-C, 3A and 3B, plural mixing bodies can be used on the dome of larger combustors spaced both circumferentially or radially. This is shown schematically as plural mixing bodies 204 in FIG. 4 on a schematic combustor 300.

In a featured embodiment, a combustor 100/200 for a gas turbine engine includes a liner 102/202 surrounding a gaseous fuel and air mixing body 104/204. A gaseous fuel supply passage 118/218 communicates into an open fuel plenum 120/220 downstream of the fuel supply passage. A wall of the mixing body has air openings 106/206 to receive air flow and communicate air into mixing passages 107/207. The mixing passages pass through the fuel plenum. Fuel openings 122/222 in the mixing passages allow fuel to flow from the fuel plenum into the mixing passages and mix with the air. Passage sections 108/208 extend downstream of the fuel plenum, such that the mixed air and fuel travels downstream of the fuel plenum and into a combustion chamber.

In another embodiment according to the previous embodiment, a source of gaseous fuel is connected to the gaseous fuel supply passage, and the source of gaseous fuel is hydrogen.

In another embodiment according to any of the previous embodiments, the mixing passages have at least two fuel openings 122 to communicate fuel from the fuel plenum into the mixing passages.

In another embodiment according to any of the previous embodiments, there is at least one of an open cell material or cellular metallic material 114/214 (CMM), at least within the passage sections downstream of the fuel plenum.

In another embodiment according to any of the previous embodiments, the at least one of the open cell material or cellular metallic material is also at a location of the fuel openings.

In another embodiment according to any of the previous embodiments, the open cell material is used and is a metal foam.

In another embodiment according to any of the previous embodiments, the fuel supply includes a central fuel passage at a generally central location in the mixing body, with the fuel plenum extending both circumferentially and radially on both sides of the central fuel passage.

In another embodiment according to any of the previous embodiments, an inner face 210 of the mixing body 204 at the combustor is generally non-planar to an axis of the central fuel passage.

In another embodiment according to any of the previous embodiments, at least some of said passage sections which are radially closer to the central fuel passage extend for a shorter axial length 212B than do other of said passage sections 212A spaced further from said central fuel passage.

In another embodiment according to any of the previous embodiments, there are a plurality of mixing bodies 204 attached to the liner.

A gas turbine engine incorporating any of the above features is also disclosed and claimed.

Although embodiments have been disclosed, a worker of skill in this art would recognize that modifications would come within the scope of this disclosure. For that reason, the following claims should be studied to determine the true scope and content.

What is claimed is:

1. A combustor for a gas turbine engine comprising:

a liner surrounding a gaseous fuel and air mixing body;

a gaseous fuel supply passage, said fuel supply passage communicating into an open fuel plenum downstream of said fuel supply passage;

a wall of the mixing body having air openings to receive air flow, and communicate air into a plurality of mixing passages, said plurality of mixing passages passing through said fuel plenum, fuel openings in the plurality of mixing passages allow fuel to flow from the fuel plenum into the plurality of mixing passages and mix with the air;

a plurality of passage sections extend downstream of the fuel plenum, such that said mixed air and fuel travels downstream of the fuel plenum and through a plurality of outlets into a combustion chamber;

wherein there is at least one of an open cell material or cellular metallic material (CMM), at least within the plurality of passage sections downstream of the fuel plenum;

wherein the at least one of the open cell material or cellular metallic material is also at a location of the fuel openings; and wherein said fuel supply includes a central fuel passage at a generally central location in the mixing body, with the fuel plenum extending both circumferentially and radially on both sides of the central fuel passage.

2. The combustor as set forth in claim 1, wherein an inner face of the mixing body at the combustor is generally non-planar to an axis of the central fuel passage.

3. The combustor as set forth in claim 2, wherein at least some of said passage sections which are radially closer to the central fuel passage extend for a shorter axial length than do others of said passage sections spaced further from said central fuel passage.

4. A gas turbine engine comprising:

a compressor section and a turbine section;

a combustor intermediate said compressor and said turbine;

a gaseous fuel supply delivering fuel into a mixing body in the combustor, a liner surrounding the mixing body;

the fuel supply communicating with a fuel supply passage, said fuel supply passage communicating into an open fuel plenum downstream of said fuel supply passage;

a wall of the mixing body having air openings to receive air flow, and communicate air into plurality of mixing passages, said plurality of said plurality of mixing passages passing through said fuel plenum, fuel openings in the plurality of said plurality of mixing passages allow fuel to flow from the fuel plenum into the mixing passages and mix with the air;

plurality of passage sections extend downstream of the fuel plenum, such that said mixed air and fuel travels downstream of the fuel plenum and through a plurality of outlets into a combustion chamber;

wherein there is at least one of an open cell material or cellular metallic materials (CMM), at least within the plurality of passage sections downstream of the fuel plenum;

wherein the open cell material or cellular metallic material is also at a location of the fuel openings; and wherein said fuel supply passage includes a central fuel passage at a generally central location in the mixing body, with the fuel plenum extending both circumferentially and radially on both sides of the central fuel passage.

5. The gas turbine engine as set forth in claim 4, wherein an inner face of the mixing body at the combustor is generally non-planar to an axis of the central fuel passage.

6. The gas turbine engine as set forth in claim 5, wherein at least some of the plurality of passage sections which are radially closer to the central fuel passage extend for a shorter axial length than do others of said plurality of passage sections spaced further from said central fuel passage.

* * * * *